US005246057A

United States Patent [19]

Hansson et al.

[11] Patent Number: 5,246,057

[45] Date of Patent: Sep. 21, 1993

[54] CAST COMPOSITE MATERIALS HAVING AN AL-MG MATRIX ALLOY

[75] Inventors: Inge L. H. Hansson; David J. Lloyd; Iljoon Jin, all of Kingston, Canada; Michael D. Skibo, Leucadia, Calif.

[73] Assignee: Alcan International Ltd., Montreal, Canada

[21] Appl. No.: 839,835

[22] Filed: Feb. 21, 1992

[51] Int. Cl.[5] ..... B22D 19/14

[52] U.S. Cl. ..... 164/97; 164/94

[58] Field of Search ..... 164/97, 900, 94

[56] References Cited

U.S. PATENT DOCUMENTS 4,382,997 5/1983 Henslee et al. .
4,916,030 4/1990 Christodoulou et al. .
4,943,413 7/1990 Tank .
5,000,242 3/1991 Burke ..... 164/97

FOREIGN PATENT DOCUMENTS 0034148 2/1983 Japan ..... 164/97

*Primary Examiner*—Mark Rosenbaum
*Assistant Examiner*—James Miner
*Attorney, Agent, or Firm*—Gregory Garmong

[57] ABSTRACT

A method for preparing a composite material comprises the steps of providing a first mixture of a molten aluminum-base matrix alloy having at least about 4 percent by weight magnesium, and a mass of discontinuous reinforcing particles that are not soluble in the molten matrix alloy, and mixing the first mixture to wet the matrix alloy to the particles and to distribute the particles throughout the volume of the molten matrix alloy. The first matrix alloy is diluted to reduce the magnesium content of the mixture to less than about 4 percent by weight magnesium, to produce a second mixture, and the second mixture is cast. The second mixture has at least about 5 volume percent particles, and preferably has about 5–25 volume percent particles.

19 Claims, 5 Drawing Sheets

CAST COMPOSITE MATERIALS HAVING AN AL-MG MATRIX ALLOY

BACKGROUND OF THE INVENTION

This invention relates to cast composite material, and, more particularly, to the preparation of such cast composite materials having an Al-Mg matrix and a reinforcing particulate such as aluminum oxide that is reactive with magnesium.

Cast composite materials are conventionally formed by melting a matrix alloy in a reactor and then adding short, discontinuous particles. The mixture is vigorously mixed to encourage wetting of the matrix alloy to the particles, and after a suitable mixing time the mixture is cast into molds or forms. The mixing is conducted while minimizing the introduction of gas into the mixture. The resulting composite materials have the particulate reinforcement distributed throughout a matrix of an alloy composition.

Such cast composite materials are much less expensive to prepare than other types of metal-matrix composite materials such as those produced by powder metallurgical technology and infiltration techniques. Composite materials produced by this approach, as described in U.S. Pat. Nos. 4,759,995, 4,786,467, and 5,028,392, have enjoyed commercial success in only a few years after their first introduction.

Desirably, the cast composite materials have fully wetted particles, few voids, and a generally uniform microstructure. Complete wetting is necessary to realize the full composite strength and other mechanical properties. Equally important is the need to avoid the formation of deleterious phases that may adversely affect the microstructure and the mechanical properties of the finished cast composite material.

The presence of magnesium in the aluminum-alloy matrix of cast composite materials reinforced with aluminum oxide particulate has posed a significant problem. Magnesium on the order of ½ percent of more is required in many aluminum alloys to achieve their full strengths during aging treatments. Aluminum matrix alloys with such large amounts of magnesium, on the order of ½ percent or more of the matrix, readily wet aluminum oxide particulate, but may also react with the particulate to produce the brittle spinel phase, $MgAl_2O_4$. The formation of the spinel phase is the principal cause of a reduction in matrix alloy magnesium content, which in turn prevents the matrix alloy from reaching its full strength potential during subsequent aging treatments. The amount of spinel formed is dependent upon three factors: the magnesium content of the matrix alloy, the mixing temperature, and the mixing time. Under normal mixing conditions, where the mixing temperature is 680–730 C. and the mixing time is 1–2 hours, the magnesium content of the alloy matrix becomes the principal determining factor of the amount of spinel formed. Aluminum matrix alloys with small amounts of magnesium do not exhibit extensive spinel formation, but also do not readily wet the aluminum oxide particulate.

There are a number of techniques that can be applied to enhance wetting or control chemical interactions between the matrix and the particles, which may work in some circumstances. The particles can be modified with special coatings, but the coating operation can significantly raise the cost of the particles and the composite material. Small amounts of reactive gases can be introduced into the mixing chamber, but the improved wetting may only be achieved at the cost of increased porosity in the cast composite material. Another approach to improved wetting is to raise the temperature at which the mixing is accomplished, but increased temperature also results in the acceleration of the production of deleterious phases where such phases are thermodynamically favored but kinetically slow in forming at lower temperatures.

There therefore exists a continuing need for an improved technique for producing cast composite materials of aluminum-magnesium alloys and reactive particles, especially aluminum oxide particles. The present invention fulfills this need, and further provides related advantages.

SUMMARY OF THE INVENTION

The present invention provides a method used in the preparation of cast composite materials with aluminum oxide (or other reactive) particulate in an aluminum-alloy matrix also containing magnesium. With this approach, spinel formation and magnesium loss due to spinel formation are greatly reduced. No foreign elements are added to the alloy, an important benefit in those cases where additions may adversely affect other properties or may be unacceptable for other reasons. The approach is practiced with conventional composite mixing apparatus.

In accordance with the invention, a method for preparing a composite material comprises the steps of providing a first mixture of a molten aluminum-base matrix alloy having at least about 4 percent by weight magnesium, and a mass of discontinuous reinforcing particles that are not soluble in the molten matrix alloy (preferably aluminum oxide particles), and mixing the first mixture to wet the matrix alloy to the particles and to distribute the particles throughout the volume of the molten matrix alloy. The first mixture is diluted to reduce the magnesium content of the matrix alloy to less than about 4 percent by weight magnesium, to produce a second mixture, and the second mixture is cast. Preferably, the matrix alloy of the cast second mixture composite material has from about ½ to about 3 weight percent magnesium, and the composite material has from about 5 to about 25 volume percent particulate reinforcement.

This invention is based upon two discoveries: first, that a molten Al-Mg alloy with at least about 4 percent by weight magnesium chemically reacts during mixing with particles such as aluminum oxide to produce a thin spinel layer at the particle-matrix interface; and, second, that if such a molten matrix alloy is prepared having at least about 4 weight percent magnesium, mixed with the particulate such that the thin spinel layer is formed at the particle-matrix interface, and then diluted to a content of less than about 4 percent magnesium, the spinel reaction at the interface does not progress in the diluted alloy to a substantial degree. The stabilization of the molten composite material against the progressive spinel reaction in the diluted alloy is important, as there is little demand for composite materials having Al-Mg alloy matrices with more than 4 weight percent Mg. The reaction characteristics of the composite material depend upon the path followed to reach the final state, and the composite material produced by the present approach is a unique material different from that produced by other techniques.

Thus, for example, an Al-2 weight percent Mg/aluminum oxide particulate composite material mixed directly using an Al-2 weight percent Mg matrix alloy will exhibit a severe spinel reaction and magnesium loss in the matrix. A composite material of the same composition, produced by first preparing a matrix alloy of at least about 4 weight percent magnesium, wetting the matrix alloy to the particulate, and then diluting the mixture by the addition of aluminum, experiences very little spinel reaction and magnesium loss in the matrix.

The composite material is preferably prepared according to an approach whereby the amount of gas in the composite material is minimized, to promote interfacial wetting and good strength properties. In accordance with this aspect of the invention, a method for preparing a composite material comprises the steps of providing a first mixture of a molten aluminum-base first mixture matrix alloy having at least about 4 percent by weight magnesium, and a mass of discontinuous aluminum oxide reinforcing particles that are not soluble in the molten matrix alloy, and mixing the first mixture to wet the molten alloy to the particles. The mixing is accomplished under conditions that the particles are distributed throughout the volume of the melt and the particles and the matrix alloy are sheared past each other to promote wetting of the particles by the matrix alloy. The mixing occurs while minimizing the introduction of any gas into, and while minimizing the retention of any gas within, the first mixture of particles and molten matrix alloy. The first mixture is then diluted to reduce the magnesium content of the matrix alloy to less than about 4 percent by weight magnesium, to produce a second mixture, and cast.

The present invention provides an important advance in the art of cast composite materials. Such materials having aluminum-magnesium matrices and reactive particles can be prepared without adding other elements to suppress the spinel reaction. Other features and advantages of the invention will be apparent from the following detailed description of the preferred embodiments, taken in conjunction with the accompanying drawings, which illustrate, by way of example, the principles of the invention.

DETAILED DESCRIPTION OF THE PREFERRED EMBODIMENTS

Figure 1:
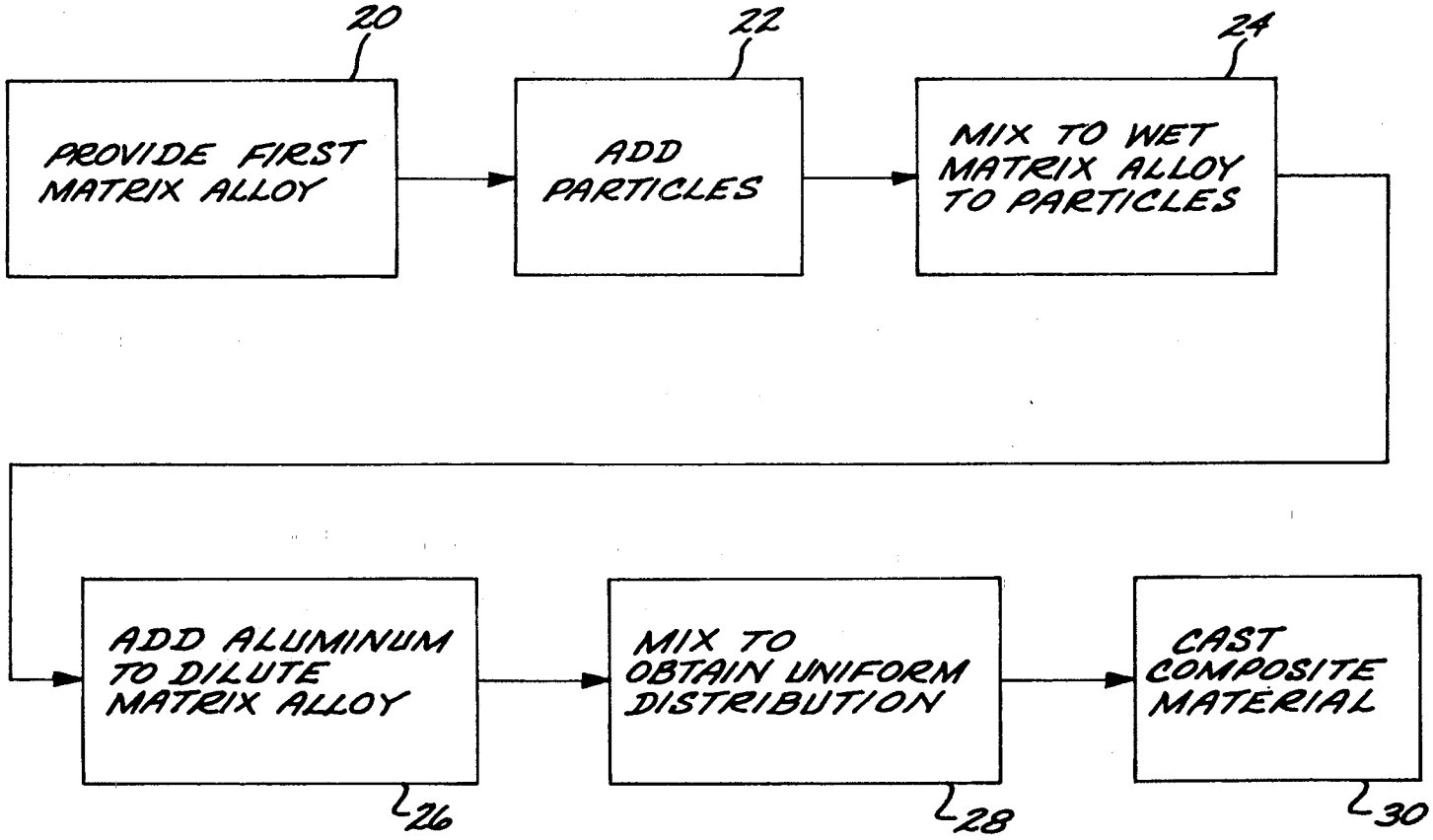
FIG. 1 is a flow chart for the method of the invention.

FIG. 1 depicts the method for preparing a composite material according to the dilution approach of the invention. In the preferred approach of FIG. 1, a first matrix alloy is provided and melted, numeral 20. The first matrix alloy is in aluminum-base alloy having at least about 4 weight percent magnesium therein, and optionally other elements such as, for example, copper, manganese, silicon, chromium, and zinc. The other elements are typically present because of their effect on mechanical or physical properties of the final cast composite material, and do not enter into the present considerations. The amounts of the other elements must be adjusted to account for the dilution of the alloy to reach the final composition. The first matrix alloy is "aluminum-base", meaning that it has more than about 50 weight percent aluminum. Lower aluminum percentages are not operable in the present approach, because after dilution the reinforcement particulate content would be too small to be of practical value.

The first matrix alloy must have at least about 4 percent magnesium by weight. If the magnesium content is lower, there is a substantial spinel reaction during the initial mixing. If the magnesium content is higher, the reaction to form a continuous protective layer is more effective. There is no technical upper limit to the magnesium content, except as imposed by the limit that the aluminum content must be greater than 50 percent by weight and by the presence of other elements in the melt. However, there is an important practical upper limit imposed by the effect of subsequent dilution on the particulate volume fraction. The magnesium content of the first matrix alloy may not be so high that, after dilution to the final or second matrix alloy content, the volume fraction of particulate will be less than the technical minimum of about 5 volume percent. Therefore, generally, it is preferred that the first matrix alloy have from about 4 to about 7 percent magnesium.

In an illustrative example of one practical application of the present approach, a composite material having an Al-4 weight percent Mg matrix and 30 volume percent aluminum oxide particulate reinforcement is mixed. After mixing, sufficient aluminum is added to dilute the aluminum-base matrix to 3 weight percent Mg, and the resulting composite material has an aluminum oxide particulate reinforcement content of 24.3 volume percent. Similarly, if the matrix is diluted to 1 weight percent Mg by the addition of aluminum, the resulting composite material has an aluminum oxide particulate reinforcement content of 9.7 percent. Both of these reinforcement contents and composite materials are of practical value. By comparison, if one starts with a magnesium-base matrix alloy such as proposed in U.S. Pat. No. 4,943,413, the final aluminum oxide content is too low to be of practical value. If a magnesium-base starting material having a 68 weight percent Mg, 32 weight percent Al matrix, with 40 volume percent aluminum oxide particulate reinforcement is diluted by the addition of sufficient aluminum to have a magnesium content of 3 weight percent, the resulting composite material has an aluminum oxide content of only 3.8 volume percent. In the case where the same starting material is diluted to a magnesium content of 1 weight percent, the resulting composite material has an aluminum oxide content of only 1.3 volume percent. These reinforcement contents are too low to be of practical value.

The matrix alloy is heated to a mixing temperature of about 680–730 C. and preferably degassed under vacuum. Particulate matter is added below the surface of the melt or to the surface, numeral 22. The particulate matter may be added all at once, or gradually during mixing. The particulate matter does not dissolve into the first matrix alloy. Preferably, there is no dissolution, but a small amount is permitted. Further, the reinforcement particles are of a composition that chemically reacts with magnesium to form a magnesium-containing phase such as the spinel phase ($MgAl_2O_4$) at the particle-matrix interface. (Chemical reaction is distinguished from dissolution, where no reaction occurs.)

The commercially most important of such particulate reinforcement materials is aluminum oxide (alumina, or $Al_2O_3$) in any of its many forms, but other materials such as compounds of several compositions including aluminum oxide are also operable in the present method. The particles may also include impurities such as other oxides in minor amounts. The need for the present invention arises because some particle types such as aluminum oxide may react at elevated temperature with the magnesium present in the matrix alloy to form spinel phase, and is therefore useful whenever the particles contain sufficient aluminum oxide to produce a substantial spinel reaction. In a typical case, the particles are 5–20 micrometers in diameter with an aspect ratio of 1–5, but these parameters are intended as examples and are not limiting of the invention. The amount of the particulate matter added is determined by the required volume fraction of particulate in the final cast composite product and the degree of dilution to reach the magnesium content of the final product. The amount of particulate in the first mixture should be sufficient to provide at least about 5 volume percent particulate in the post-dilution mixture. Lesser amounts of particulate below this minimum volume fraction are not effective in improving the properties of the composite, and do not justify the expense of preparing a composite material. Desirably, the amount of particulate in the final cast composite material product is from about 5 to about 25 volume percent.

The particulate and the first matrix alloy are mixed together, numeral 24, to wet the matrix alloy to the particles. In the preferred batch mixing process, the mixing is performed under vacuum and with a high-shear mixing impeller that does not create a vortex in the mixture. The mixing is continued for a sufficiently long time, typically 30–60 minutes, to achieve wetting of the first matrix alloy to the particles and to ensure the formation of the thin protective layer at the particle-matrix interface. Such mixing techniques and the associated apparatus are known in the art, and are described, for example, in U.S. Pat. Nos. 4,759,995, 4,786,467, and 5,028,392, whose disclosures are incorporated by reference.

The result of the process at this point is a composite melt having a first matrix alloy of at least about 4 weight percent magnesium, wetted to particles such as aluminum oxide particles. The preceding discussion has disclosed the preferred approach for preparing this first mixture, but it may be prepared by any operable technique. The first mixture at this point may be used in the following steps without casting it to a solid form. Alternatively, the first mixture may be cast into a solid form, and then either stored or shipped to another location for dilution.

The first mixture is diluted with respect to magnesium to reduce the magnesium content of the matrix alloy to less than about 4 percent by weight magnesium, numeral 26, to produce a second mixture. The dilution is preferably accomplished by adding aluminum or an aluminum alloy containing no or little magnesium to the mixture. The diluting alloy should not include unwetted particles, as they would never become wetted and would also suffer degradation due to progressive spinel formation in the diluted alloy. The dilution reduces the percentage concentration of magnesium in the molten matrix alloy as well as the percentage concentration of other elements and the volume fraction of the particulate in the mixture. For this reason, the initial concentrations in the first mixture must be selected with the dilution material in mind, so that the second mixture has the desired final composition.

The added dilution material is mixed into the first mixture to achieve a complete dispersion throughout the melt, numeral 28. This mixing can be a relatively gentle, short mixing, inasmuch as its purpose is only to produce a uniform melt, not wet the molten matrix alloy to the particles. One important advantage of the present invention is that the dilution technique, while having a desirable effect on spinel formation, does not adversely affect the wetting of the molten matrix alloy to the particles that was achieved prior to dilution. High-shear mixing can be performed if desired, but it is not necessary if wetting was achieved in the first mixture.

After dilution and mixing, the second mixture is cast into a solid form, numeral 30. Any casting technique may be used, including for example, ingot, pig, DC, or continuous casting. The cast composite material is ready for use.

Some studies were performed to illustrate the present dilution approach to the preparation of cast composite materials, and to compare the dilution approach with the prior approach of preparing the cast composite material directly with the final matrix composition.

In the first set of studies, a series of composite materials were prepared by the direct mixing approach at 720 C. in vacuum with Al-Mg alloy matrices and 15 volume percent aluminum oxide particulate. The amount of magnesium in the initial melt was varied from 1.24 percent by weight to 7.00 percent by weight. Samples were taken and analyzed for magnesium content of the matrix after 45 and 90 minutes of mixing, and the results are reported in Table I, with all magnesium contents in percent by weight of the matrix.

TABLE I

| Initial Mg Concentration | Mg Concentration After 45 Min. | Mg Concentration After 90 Min. |
|---|---|---|
| 1.24 | 0.42 | 0.27 |
| 2.07 | 1.18 | 1.01 |
| 2.70 | 1.80 | 1.75 |
| 3.06 | 2.63 | 2.46 |
| 4.08 | 3.98 | 3.87 |
| 7.00 | 7.12 | — |

Figure 2:
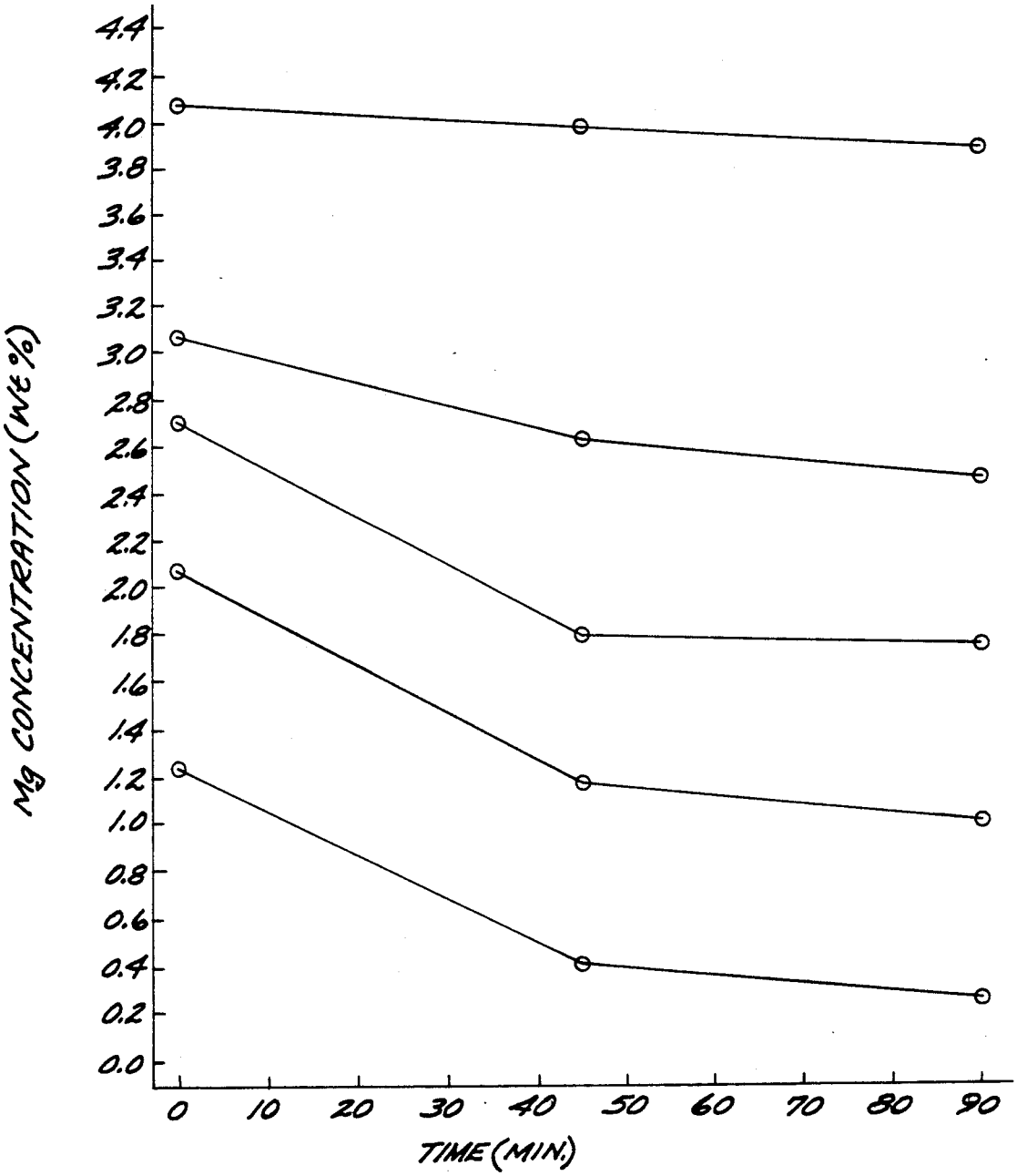
FIG. 2 is a graph of magnesium content of the matrix alloy of an Al-Mg/15 volume percent aluminum oxide melt as a function of time for the direct mixing approach.
Figure 3:
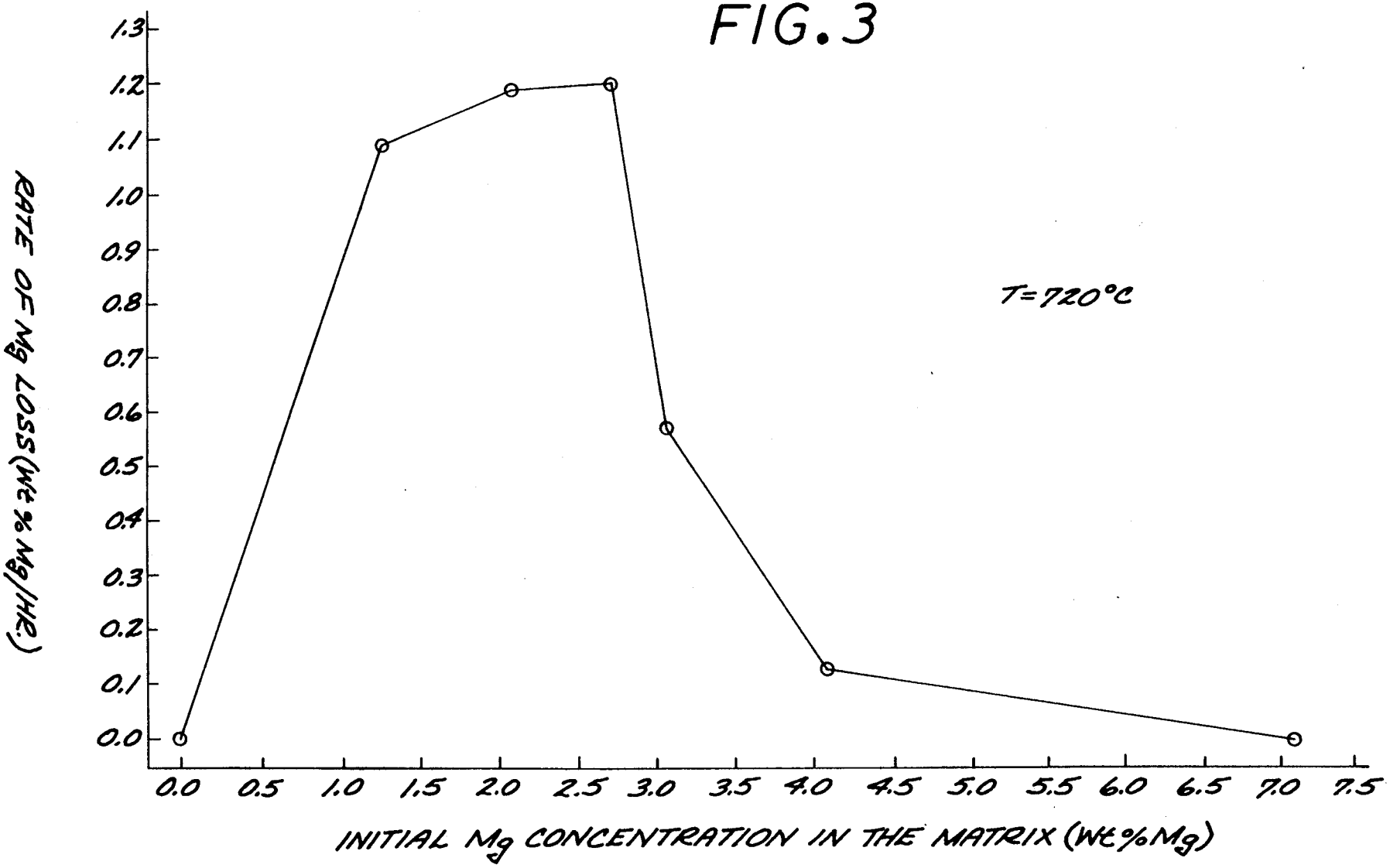
FIG. 3 is a graph of the rate of magnesium loss of the matrix alloy as a function of initial magnesium content of the matrix alloy, for alloys produced by the direct mixing approach.

FIG. 2 presents the results graphically, with the data for the initial concentration of 7.00 percent Mg omitted to permit expansion of the scale for the other results. It is apparent both from FIG. 2 and Table I that the magnesium loss is more rapid from lower magnesium content alloys than from higher magnesium content alloys. FIG. 3 presents the rate of magnesium loss as a function of initial magnesium content, graphically illustrating the increasing rate of magnesium loss for initial magnesium contents of up to about 3 percent magnesium, and a decreasing rate above that value. Above about 4 percent initial magnesium content the rate of loss becomes near-zero. The range of initial magnesium content between about 3 and about 4 weight percent therefore is a transition region from a large magnesium loss at lower values to near-zero magnesium loss at higher values. The term "about 4 percent" used herein is intended to reflect the critical magnesium concentration above which the magnesium loss to spinel formation is nearly zero. Other tests similar to those just described were performed to determine the rate of loss of magnesium at 705 C. and 740 C., and produced similar results.

Other studies have shown that the loss of magnesium from the matrix is due primarily to the formation of spinel phase due to reaction of magnesium in the matrix alloy with aluminum and oxygen in the aluminum oxide particles. Some magnesium may be lost to vaporization, but the amount is relatively small. Thus, the data of FIG. 3 also indicates that below about 4 weight percent magnesium there is substantial spinel formation, and above about 4 weight percent magnesium there is greatly reduced spinel formation.

In the dilution approach of the invention, the primary mixing is achieved in an alloy having at least about 4 percent by weight magnesium, to achieve the benefits of this suppression of progressive spinel formation at elevated temperature. The suppression of progressive spinel formation is believed to result from the preferential in-situ formation of a continuous protective layer at the surface of the particles. It is believed that the protective layer consists of extremely fine crystallites (10–100 nanometer) of spinel. Once this layer is formed at the surface of the aluminum oxide particle, further progression of the spinel formation reaction is suppressed. However, the operability of the present invention is not dependent upon any mechanism, and is not limited by the understanding of the mechanism.

A second series of tests was performed to assess the effect of diluting a first mixture having an Al-Mg matrix alloy with the magnesium greater than about 4 weight percent, and aluminum oxide particles. A first mixture was prepared in the manner described previously, having an Al-4.7 weight percent Mg matrix and 20 volume percent aluminum oxide particles. Samples of this alloy were diluted to various magnesium contents by the addition of commercially pure aluminum. The diluted melts were stirred continuously for 120 minutes, and samples for the determination of magnesium content of the melt were taken at 60 minutes and 120 minutes. Table II presents the results, with the amount of magnesium stated in weight percent of the second matrix alloy:

TABLE II

| Initial Mg Concentration | Mg Concentration After 60 Min. | Mg Concentration After 120 Min. |
|---|---|---|
| 0.18 | 0.16 | 0.19 |
| 0.37 | 0.33 | 0.29 |
| 1.21 | 1.22 | 1.15 |
| 1.90 | 1.80 | — |
| 2.81 | 2.67 | 2.64 |

Figure 4:
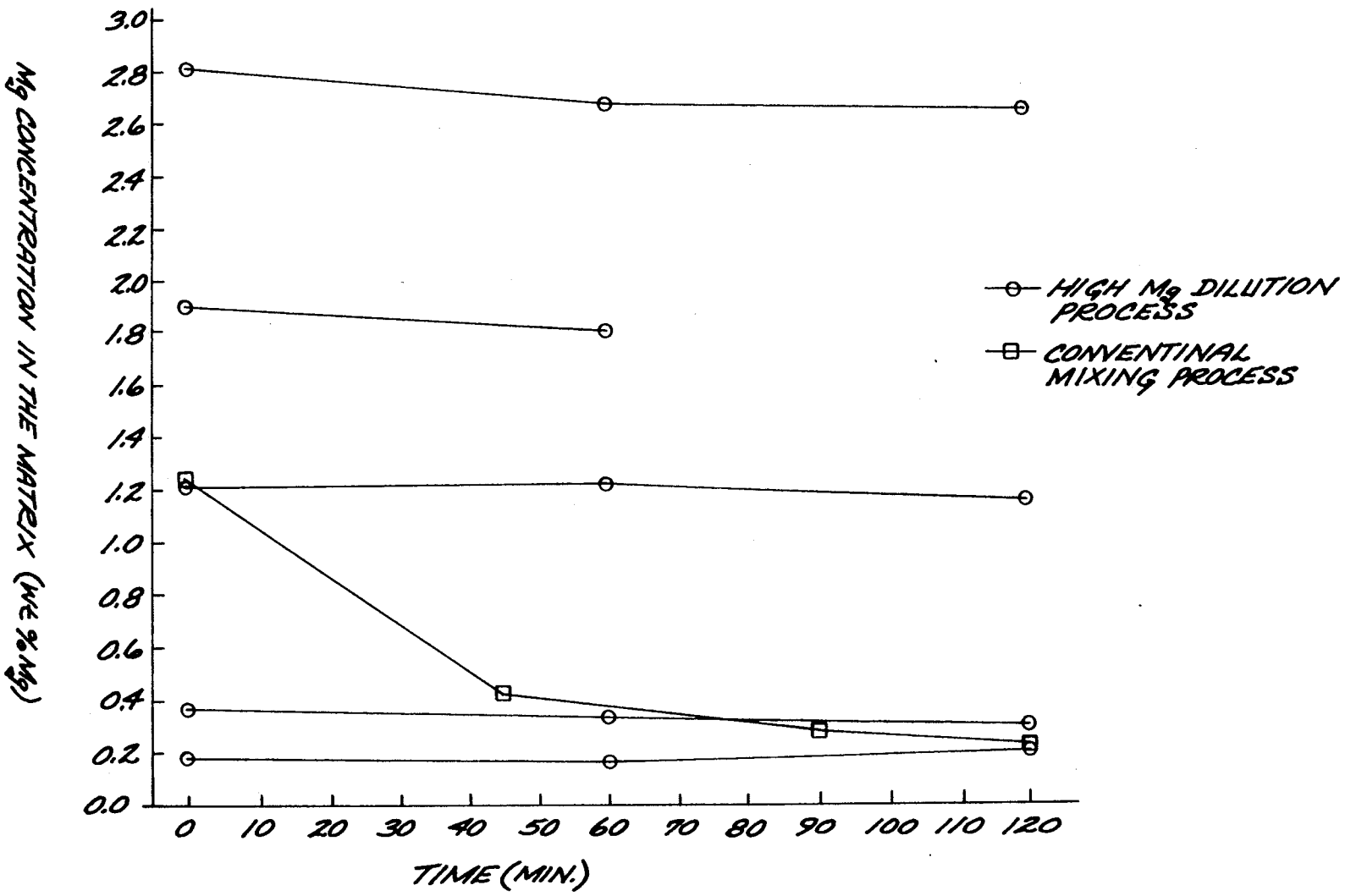
FIG. 4 is a graph of magnesium content of the matrix alloy of an Al-Mg/15 volume percent aluminum oxide melt as a function of time, comparing the materials produced by direct mixing and by the dilution approach.

The results are presented graphically in FIG. 4, together with one of the curves from FIG. 2 for comparison. The composite melts formed by the dilution approach experienced very little loss of magnesium content of the matrix during the post-dilution exposure. By contrast, the composite melt formed by the direct mixing approach experienced large magnesium loss in the same period.

From these results it is concluded that the stabilizing mechanism which was effective at magnesium contents above about 4 weight percent is retained after dilution of the composite melt to magnesium contents of less than about 4 weight percent. The retention of the stabilizing effect following dilution is significant. While the effect at magnesium contents greater than 4 percent has some application, most aluminum-based, magnesium-containing alloys have magnesium contents on the order of about ½–3 percent. The dilution approach permits cast composite materials of these magnesium contents to be prepared while avoiding damaging spinel formation.

The retention of stabilization is also important because magnesium-containing composite melts may be held at the casting temperature for extended periods of time. In a commercial casting operation, it is sometimes necessary to hold a melt at the casting temperature for several hours. An inert gas blanket protects against oxidation of the melt, but the spinel-forming spinel reaction proceeds in melts prepared by the direct melting process regardless of protection against surface oxidation. The present dilution approach suppresses the spinel reaction in diluted alloys, so that they may be retained at the casting temperature for a period of time.

Figure 5:
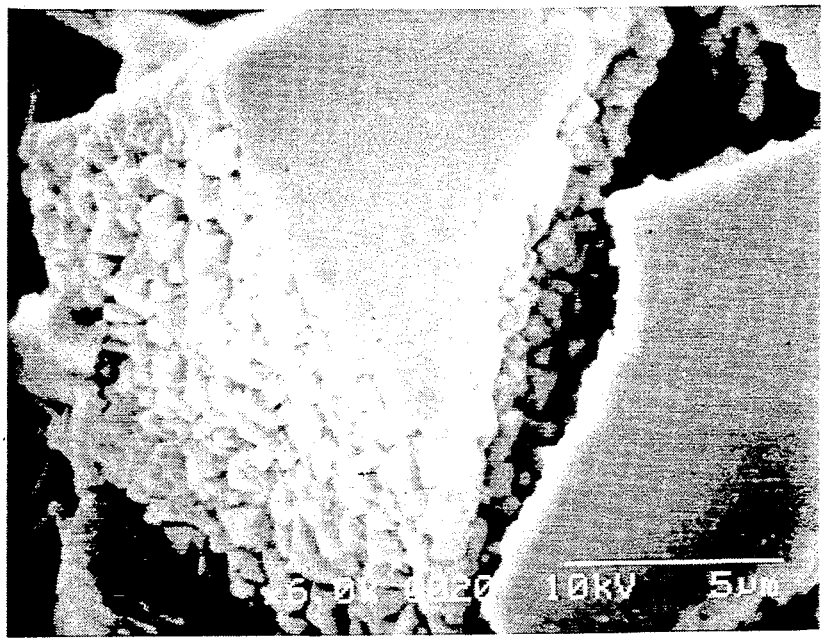
FIG. 5 is a photomicrograph of an Al-2 weight percent Mg/15 volume percent aluminum oxide cast composite material, prepared by direct mixing.
Figure 6:
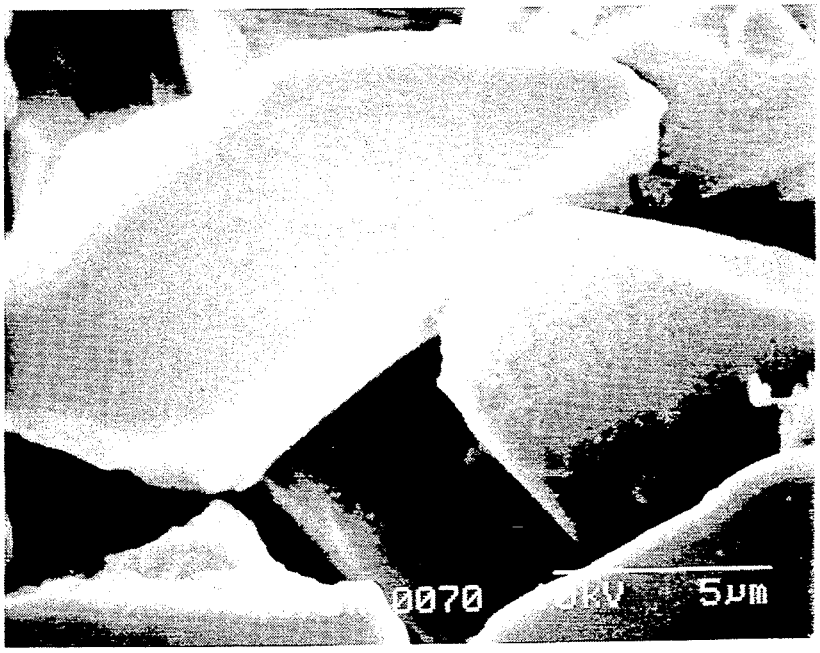
FIG. 6 is a photomicrograph of an Al-1.9 weight percent Mg/15 volume percent aluminum oxide cast composite material, prepared by the dilution approach.

FIGS. 5 and 6 show the microstructures of composite materials prepared by the direct mixing (FIG. 5) and dilution (FIG. 6) approaches, and then held at temperature for 60 minutes before casting. (The microstructures are etched in aqua regia, which attacks the aluminum-alloy matrix but not the aluminum oxide or the spinel. The micrographs therefore illustrate the nature of the particle surface in contact with the matrix alloy.) The materials have comparable initial magnesium contents of about 2 percent. The composite material prepared by direct mixing has a substantial amount of spinel in the microstructure, while the composite material prepared by the dilution approach has only a fine crystallite protective layer. Thus, the material prepared by the dilution approach is unique, and not comparable to the material produced by the direct approach. The avoidance of progressive spinel formation has two important beneficial effects: improvement of the microstructure and properties by elimination of spinel, and eliminating the loss of magnesium from the matrix which in turn limits the strength that can be achieved in the matrix by later heat treatment.

Although particular embodiments of the invention have been described in detail for purposes of illustration, various modifications may be made without departing from the spirit and scope of the invention. Accordingly, the invention is not to be limited except as by the appended claims.

What is claimed is:

1. A method for preparing a composite material, comprising the steps of:

providing a first mixture of a molten aluminum-base matrix alloy having at least about 4 percent by weight magnesium, and a mass of discontinuous reinforcing particles that are not soluble in the molten matrix alloy;

mixing the first mixture to wet the matrix alloy to the particles and to distribute the particles throughout the volume of the molten matrix alloy;

diluting the first mixture to reduce the magnesium content of the matrix alloy to less than about 4 percent by weight magnesium, to produce a second mixture; and casting the second mixture.

2. The method of claim 1, wherein the second mixture has at least about 5 percent by volume of particles.

3. The method of claim 1, wherein the second mixture has from about 5 to about 25 percent by volume of particles.

4. The method of claim 1, wherein the magnesium content of the first mixture matrix alloy is from about 4 to about 7 weight percent magnesium.

5. The method of claim 1, wherein the magnesium content of the second mixture matrix alloy is from about ½ to about 3 weight percent magnesium.

6. The method of claim 1, wherein a vacuum is applied to the first mixture during the step of mixing.

7. The method of claim 1, wherein the step of diluting is accomplished by adding aluminum to the first mixture.

8. The method of claim 1, wherein the reinforcing particles are of a material that chemically reacts with magnesium.

9. The method of claim 1, wherein the reinforcing particles contain aluminum oxide.

10. The method of claim 1, including the additional steps, after the step of mixing the first mixture and before the step of diluting the first mixture, of casting the first mixture; and thereafter remelting the first mixture.

11. A method for preparing a composite material, comprising the steps of:

providing a first mixture of a molten aluminum-base first mixture matrix alloy having at least about 4 percent by weight magnesium, and a mass of discontinuous aluminum oxide reinforcing particles that are not soluble in the molten matrix alloy;

mixing the first mixture to wet the molten alloy to the particles, under conditions that the particles are distributed throughout the volume of the melt and the particles and the matrix alloy are sheared past each other to promote wetting of the particles by the matrix alloy, the mixing to occur while minimizing the introduction of any gas into, and while minimizing the retention of any gas within, the first mixture of particles and molten matrix alloy;

reducing the magnesium content of the matrix alloy to less than about 4 percent by weight magnesium, to produce a second mixture; and casting the second mixture.

12. The method of claim 11, wherein a vacuum is applied to the first mixture during the step of mixing.

13. A method for preparing a composite material, comprising the steps of:

providing a first mixture comprising a molten aluminum-base matrix alloy having at least about 4 percent by weight magnesium, and a mass of discontinuous reinforcing particles that are not soluble in the molten matrix alloy, the matrix alloy being wetted to the particles;

diluting the first mixture to reduce the magnesium content of the matrix alloy to less than about 4 percent by weight magnesium, to produce a second mixture; and casting the second mixture.

14. The method of claim 13, wherein the step of providing includes the step of mixing the first mixture to wet the matrix alloy to the particles and to distribute the particles throughout the volume of the molten matrix alloy.

15. The method of claim 14, wherein a vacuum is applied to the first mixture during the step of mixing.

16. The method of claim 13, wherein the second mixture has at least about 5 percent by volume of particles.

17. The method of claim 13, wherein the magnesium content of the first mixture matrix alloy is from about 4 to about 7 weight percent magnesium.

18. The method of claim 13, wherein the magnesium content of the second mixture matrix alloy is from about ½ to about 3 weight percent magnesium.

19. The method of claim 13, wherein the reinforcing particles contain aluminum oxide.

* * * * *